US005271172A

United States Patent [19]

Ureta

[11] Patent Number: 5,271,172

[45] Date of Patent: Dec. 21, 1993

[54] SCHEDULING DEVICE

[76] Inventor: Luis A. Ureta, 4871 Wiota St., Los Angeles, Calif. 90041

[21] Appl. No.: 822,705

[22] Filed: Jan. 21, 1992

[51] Int. Cl.[5] ..... G09D 3/00

[52] U.S. Cl. ..... 40/107

[58] Field of Search ..... 40/107, 110, 118, 109, 40/113, 114, 115; 283/2, 3, 4; 368/28, 62

[56] References Cited

U.S. PATENT DOCUMENTS

| | | | |
|---|---|---|---|
| 2,044,808 | 6/1936 | Povelsen | 368/28 |
| 2,134,138 | 10/1938 | Manzler | 40/110 |
| 3,964,196 | 6/1976 | Ureata | 40/107 |
| 4,549,154 | 10/1985 | Thoma | 368/62 X |
| 4,863,193 | 9/1989 | Keshani | 40/107 X |

*Primary Examiner*—Kenneth J. Dorner

*Assistant Examiner*—Milton Nelson, Jr.

[57] ABSTRACT

A device for displaying a schedule of activities in which an activity display has indicia listed thereon for being assigned to respective activities to be identified thereon, in combination with a twenty-four hour clock face display including thereon forty-eight enclosed spaces successively arranged around the clock face in half-hourly increments for respectively displaying the activity display indicia around the clock face according to the schedule of the activities to which the indicia have been assigned. Twenty-four of the forty-eight enclosed spaces are respectively positioned at the hour divisions of the clock face, and the other twenty-four of the forty-eight enclosed spaces are respectively positioned between successive ones of the hour divisions.

6 Claims, 1 Drawing Sheet

SCHEDULING DEVICE

BACKGROUND OF THE INVENTION

This invention relates to the improvement of the Schelendar, with U.S. Pat. No. 3,964,196 dated Jun. 22, 1976 by Luis A. Ureta, combining its major improved novel and functional features with the calendar.

In this industrial and high technology world, time is so valuable that wasting it is not good for business. Scheduling time on activities and appointments and keeping them is a must. Because of its importance, various scheduling devices and organizers had been invented and designed to schedule effectively activities and appointments—the daily desk calendar, the weekly appointment books, the executive table-top appointment calendars, the wall calendars and other similar items. All of them are limited in scope to cover all activities and appointments twenty-four hours a day, seven days a week, four weeks a month and twelve months a year in advance. It seems impossible to achieve, but after several years of serious studies, a solution has been made. The functional Super Schelendar now provides the necessary novel features that can schedule unlimited number of activities and appointments the whole year in advance, at half-hourly increments.

The original Schelendar activity schedule display device is redesigned to meet the need for maximum efficiency and organized scheduling. With the twenty-four divisions, representing the twenty-four hours of day, additional forty-eight more geometrical shapes were added and incorporated, arranged around the central twenty-four hour clock configuration. In the original design of the Schelendar, scheduling is done in hourly increments. This novel improvement on the activity schedule display device, scheduling can be done in half-hourly increments. The original Schelendar uses activity pins with letter symbols, but on this improvement, the activity pins were omitted. Instead, an activity/appointment numbered or lettered line spaces in columns are provided, where the user jots down his or her activities and appointments on these spaces, automatically assigning a number or letter to every activity and appointment written. These numbers or letters will be used and written on the activity schedule display device, particularly within the forty-eight geometrical shapes, locating them in their respective time, day and date, resulting in a clean-cut and organized scheduling. At one glance, the user can see all his or her activities and appointments. Scheduling two or more activities on a scheduled time is always prevented.

SUMMARY OF THE INVENTION

The principal purpose of this invention, is to provide an organized scheduling device that can schedule unlimited number of activities and appointments at half-hour increments, twenty-four hours a day, seven days a week, four weeks a month and twelve months a year in advance. It should be easy to use, cheap to manufacture within the reach of everyone and can keep a complete clean record of all activities and appointments the whole year, without messy erasures, even if changes and/or cancellations occur.

With these novel improvements, the functional Super Schelendar combined with the calendar, could be used in all kinds and versions of calendars, be it daily, weekly, monthly or wall calendars. Probably, the Super Schelendar will revolutionize the calendar industry.

Aside using the features of the calendar, it is a scheduling and a recording device.

Briefly described, the device for displaying a schedule of activities according to the present invention comprises, in combination, an activity display having indicia (such as letters or numbers) listed thereon for being assigned to respective ones of the activities to be identified thereon by a user; and a twenty-four hour clock face display having twenty-four hour divisions and including thereon forty-eight enclosed spaces successively arranged around the face in half-hourly increments, for displaying respective ones of the indicia in the enclosed spaces around the clock face according to the schedule of the activities to which the indicia have been assigned. The forty-eight enclosed spaces include a first twenty-four of such enclosed spaces respectively positioned at the twenty-four hour divisions, and a second twenty-four of such enclosed spaces respectively positioned between successive ones of the twenty-four hour divisions. In the preferred embodiment, each of the first twenty-four enclosed spaces has a first geometrical shape (for example, a circle) and each of the second twenty-four enclosed spaces has a second geometrical shape different from the first geometrical shape.

Figure 1:
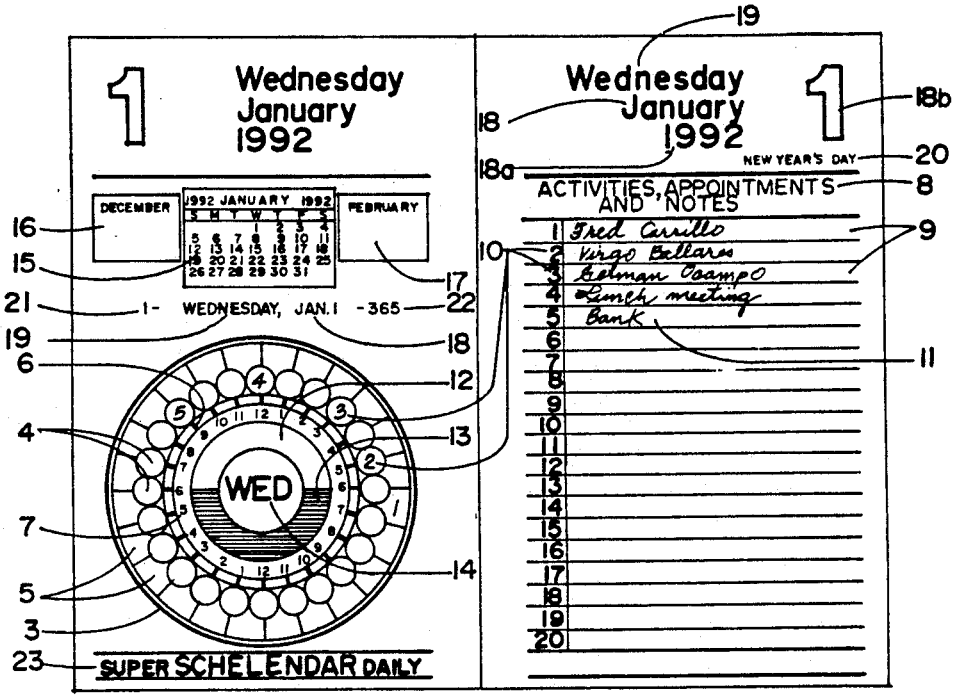
FIG. 1 shows the complete one day presentation of a daily Super Schelendar.

The large figure, circular in shape (3) or in any geometrical shape is the daily activity schedule display device. The twenty-four short heavy lines (6) represents the twenty-four divisions denoting the twenty-four hours of the day. The numbering 1 to 12 (7) denotes the time of the day. For Armed Forces use, the numbering will be 1 to 24. The shaded area (13) denotes 12 hours of night time (color may be used instead of the shading), and the unshaded area (12) denotes 12 hours of day time (color may be used also). The twenty-four small circles (4) or in any geometrical shape are the spaces where the activity numbers (10) or letters are written for hourly activities and the other twenty-four enclosed spaces (5) outside and between the small circles (4) are the spaces where half-hourly activities are written. The title, Activities, Appointments and Notes (8) is the area where activities, appointments and notes (11) are written on the numbered or lettered line spaces (9) in columns. The user writes all his or her activities and appointments (11) in the line spaces (9) at the listed number or letter indicia (10), automatically assigns a number (10) or letter for every activity or appointment written.

The central circle (14) or in any geometrical shape denotes the day. The present month (15), the month before (16) and the month after (17) are shown side by side for easy reference. The date (18*b*), day (19), month (18) and the year (18*a*) are shown separated from the scheduling device for easy visualization. The name of holidays (20) may be shown at two locations. The nth day of the year (21) and the number of days left in the year (22) are also shown. The model of the Super Schelendar (23) is indicated, whether it is daily, weekly or monthly.

DETAILED DESCRIPTION OF THE INVENTION

Figure 2:
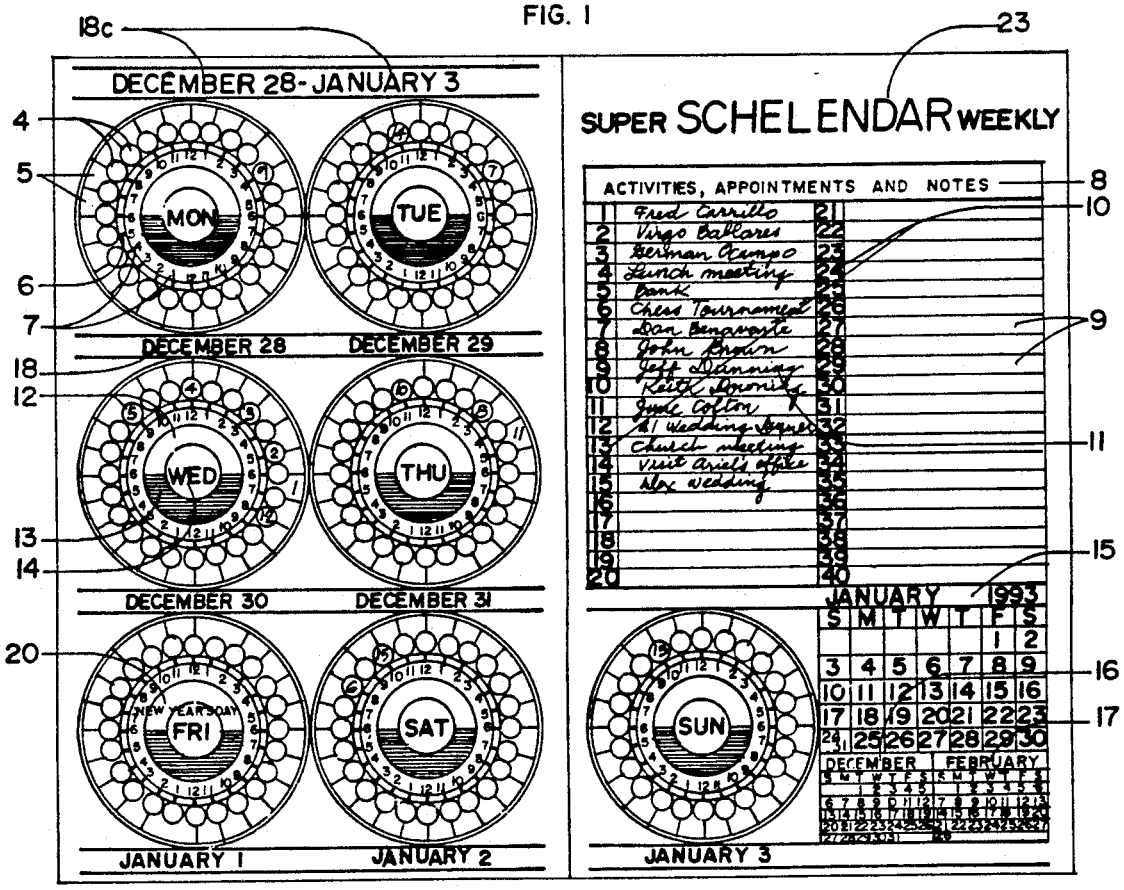
FIG. 2 shows the complete one week presentation of the weekly Super Schelendar.

Two graphic presentation of the Super Schelendar are shown—FIG. 1 the daily Super Schelendar and FIG. 2 the weekly Super Schelendar. The daily activity schedule display device is divided into twenty-four parts numbering 1 to 12, 1 to 12 representing the twenty-four hours of the day. Inside the twenty-four hour clock configuration, a shaded area is shown denoting 12 hours (6 PM to 6 AM) of night time and the unshaded area denotes 12 hours (6 AM to 6 PM) of day time. The twenty-four small circles (4) are attached to the twenty-four short lines denoting the twenty-four hour divisions, and another twenty-four enclosed spaces (5) are arranged between successive ones of the twenty-four hour divisions around and between the small circles (4). These forty-eight enclosed spaces (4, 5) will be used for scheduling activities and appointments.

Activities, appointments and notes are written on the numbered or lettered line spaces in columns. Number of line spaces and columns varies in different models. The user write all his or her activities and appointments in the numbered or lettered line spaces, automatically assigns a number or letter for every activity or appointment written. Using these numbers or letters, the user locate and write the number or letter within the forty-eight enclosed spaces in the activity schedule display device—on the small circles for the hourly activities and for the half-hourly activities on the outer spaces between the small circles.

With these novel features of the functional Super Schelendar combined with the calendar, a person may schedule unlimited number of activities and appointments without any difficulty. A complete clean record of all activities and appointments may be kept the whole year, even if there are changes and cancellations of the activities and appointments. These changes and cancellation may also be recorded.

Although the description above contain many specificities, these should not be construed as limiting the scope of the invention, but merely providing illustrations of some of the presently preferred embodiments of the invention. Thus, the scope of the invention should be determined by the appended claims and their legal equivalents, rather than by the examples given.

I claim:

1. A device for displaying a schedule of activities, comprising in combination:

an activity display on the device, said display having indicia listed thereon for being assigned to respective ones of the activities to be identified thereon; and a twenty-four hour clock face display on the device, said clock face display having twenty-four hour divisions and including thereon forty-eight enclosed spaces successively arranged around said face in half-hourly increments, for displaying respective ones of said indicia in said enclosed spaces around said clock face according to the schedule of the activities to which said indicia have been assigned.

2. The device according to claim 1, wherein:

said indicia are numbers.

3. The device according to claim 1, wherein:

said indicia are letters.

4. The device according to claim 1, wherein:

each of said first twenty-four of said enclosed spaces has a first geometrical shape, and each of said second twenty-four of said enclosed spaces has a second geometrical shape different from said first geometrical shape.

5. The device according to claim 1, wherein:

said forty-eight enclosed spaces on said twenty-four hour clock face display include a first twenty-four of said enclosed spaces respectively positioned at said twenty-four hour divisions and a second twenty-four of said enclosed spaces respectively positioned between successive ones of said twenty-four hour divisions.

6. The device according to claim 5, wherein:

each of said first twenty-four enclosed spaces describe a circle.

* * * * *